US010181649B2

(12) United States Patent
Ma et al.

(10) Patent No.: US 10,181,649 B2
(45) Date of Patent: Jan. 15, 2019

(54) ANTENNA AND MOBILE TERMINAL

(71) Applicant: Huawei Device (Dongguan) Co., Ltd., Dongguan (CN)

(72) Inventors: Tae Jin Ma, Shenzhen (CN); Yongbo Yue, Beijing (CN); Chunhui Ye, Beijing (CN)

(73) Assignee: Huawei Device (Dongguan) Co., Ltd., Dongguan (CN)

( * ) Notice: Subject to any disclaimer, the term of this patent is extended or adjusted under 35 U.S.C. 154(b) by 304 days.

(21) Appl. No.: 15/037,227

(22) PCT Filed: Nov. 18, 2013

(86) PCT No.: PCT/CN2013/087366

§ 371 (c)(1),
(2) Date: May 17, 2016

(87) PCT Pub. No.: WO2015/070467

PCT Pub. Date: May 21, 2015

(65) Prior Publication Data

US 2016/0294064 A1 Oct. 6, 2016

(51) Int. Cl.

| | |
|---|---|
| ***H01Q 1/36*** | (2006.01) |
| ***H01Q 9/16*** | (2006.01) |
| ***H01Q 1/24*** | (2006.01) |
| ***H01Q 1/48*** | (2006.01) |

(52) U.S. Cl.

CPC ..... *H01Q 9/16* (2013.01); *H01Q 1/243* (2013.01); *H01Q 1/36* (2013.01); *H01Q 1/48* (2013.01)

(58) Field of Classification Search

CPC ..... H01Q 9/16; H01Q 9/243; H01Q 9/36; H01Q 9/48

USPC ..... 343/795

See application file for complete search history.

(56) References Cited

U.S. PATENT DOCUMENTS

| | | | | |
|---|---|---|---|---|
| 5,966,097 | A | 10/1999 | Fukasawa et al. | |
| 9,350,077 | B1 * | 5/2016 | Zheng | H01Q 7/00 |
| 9,634,385 | B2 * | 4/2017 | Feng | H01Q 9/42 |
| 9,698,857 | B1 * | 7/2017 | Lee | H04B 1/401 |
| 2007/0146205 | A1 * | 6/2007 | Pelzer | H01Q 1/243 343/700 MS |
| 2007/0146221 | A1 | 6/2007 | Oshiyama et al. | |
| 2008/0129630 | A1 | 6/2008 | Baliarda et al. | |
| 2009/0295669 | A1 | 12/2009 | Su et al. | |
| 2010/0328177 | A1 | 12/2010 | Kemp et al. | |
| 2011/0019749 | A1 * | 1/2011 | Wilhelmsson | H04L 25/022 375/259 |

(Continued)

FOREIGN PATENT DOCUMENTS

| | | | |
|---|---|---|---|
| CN | 1669182 | A | 9/2005 |
| CN | 101593870 | A | 12/2009 |

(Continued)

*Primary Examiner* — Lam T Mai

(57) ABSTRACT

Embodiments of the present invention disclose an antenna and a mobile terminal, which are relate to the field of antenna technologies, so as to improve radiation performance of the antenna. The antenna includes a first antenna arm and a second antenna arm that are not in contact with each other, where one end of the first antenna arm is configured for grounding, one end of the second antenna arm is configured to connect to a feed point, and the first antenna arm and the second antenna arm have at least one relative area.

9 Claims, 4 Drawing Sheets

(56) References Cited

U.S. PATENT DOCUMENTS

| | | | | |
|---|---|---|---|---|
| 2011/0128200 | A1 | 6/2011 | Hossain et al. | |
| 2013/0171951 | A1 | 7/2013 | Li et al. | |
| 2014/0100004 | A1* | 4/2014 | Yarga ..... | H01Q 1/243 455/575.8 |

FOREIGN PATENT DOCUMENTS

| | | | |
|---|---|---|---|
| CN | 101849321 | A | 9/2010 |
| CN | 103187625 | A | 7/2013 |
| CN | 103337693 | A | 10/2013 |
| CN | 203260723 | U | 10/2013 |
| KR | 20070069074 | A | 7/2007 |
| WO | 2010/111783 | A1 | 10/2010 |

* cited by examiner

ANTENNA AND MOBILE TERMINAL

CROSS-REFERENCE TO RELATED APPLICATIONS

The present application claims priority under 35 U.S.C. § 365 to International Patent Application No. PCT/CN2013/087366 filed Nov. 18, 2013, which is incorporated herein by reference into the present disclosure as if fully set forth herein.

TECHNICAL FIELD

The present invention relates to the field of antenna technologies, and in particular, to an antenna and a mobile terminal.

BACKGROUND

The LTE (Long Term Evolution) is a Long Term Evolution technology of the 3rd Generation Partnership Project (3GPP, 3rd Generation Partnership Project), and is considered as a mainstream technology for evolution toward 4G. In the field of mobile terminals, particularly in a low-frequency band spectrum range, design of a miniature antenna with lower frequencies, a wider bandwidth, and higher performance is required for implementing the LTE technology. In addition, a development trend of a mobile terminal is ultra-thinness, multifunction, a large-power battery, and the like. Therefore, a higher requirement is imposed on design of an antenna of the mobile terminal.

Application of a dipole antenna to an existing handheld mobile terminal is relatively common. As shown in FIG. 1, the dipole antenna includes two antenna arms (a first antenna arm 11 and a second antenna arm 12), the two antenna arms are located on a same plane, "F" represents a feed end (Feed), and "G" represents a grounding end (Ground).

Although the dipole antenna can produce radiant energy, an upper hemisphere partial radiated power (UHPRP, Upper Hemisphere Partial Radiation Power) and upper hemisphere isotropic sensitivity (UHIS, Upper Hemisphere Isotropic Sensitivity) of the antenna are not high, thereby reducing radiation performance of the antenna.

SUMMARY

Embodiments of the present invention provide an antenna and a mobile terminal, which are configured to improve radiation performance of the antenna.

To achieve the foregoing objective, the following technical solutions are used in the embodiments of the present invention:

According to a first aspect, an embodiment of the present invention provides an antenna, including: a first antenna arm and a second antenna arm that are not in contact with each other, where one end of the first antenna arm is configured for grounding, one end of the second antenna arm is configured to connect to a feed point, and the first antenna arm and the second antenna arm have at least one relative area.

In a first possible implementation manner, according to the first aspect, an arm distance between the first antenna arm and the second antenna arm is a constant value within any one of the relative area/areas.

In a second possible implementation manner, according to the first possible implementation manner, the first antenna arm and the second antenna arm have at least two relative areas, and arm distances between the first antenna arm and the second antenna arm are equal within the at least two relative areas.

In a third possible implementation manner, with reference to the first aspect or either one of the foregoing two possible implementation manners of the first aspect, the first antenna arm and the second antenna arm are flake-shaped or line-shaped.

In a fourth possible implementation manner, according to the third possible implementation manner, the first antenna arm and the second antenna arm are flake-shaped, and a width of the first antenna arm is equal to a width of the second antenna arm.

According to a second aspect, an embodiment of the present invention provides a mobile terminal, including a housing and the antenna described in the first aspect or any one of possible implementation manners of the first aspect, where a first antenna arm of the antenna is located on an inner side of a second antenna arm of the antenna.

In a first possible implementation manner, according to the second aspect, the antenna is located inside the housing of the mobile terminal, and is located in a corner of the mobile terminal.

In a second possible implementation manner, with reference to the second aspect or the first possible implementation manner of the second aspect, the antenna is disposed on a periphery of an internal device of the mobile device.

According to an antenna and a mobile terminal provided in the embodiments of the present invention, the antenna includes a first antenna arm and a second antenna arm that are not in contact with each other, where one end of the first antenna arm is configured for grounding, one end of the second antenna arm is configured to connect to a feed point, and the first antenna arm and the second antenna arm have at least one relative area, so that the first antenna arm performs coupling with the second antenna arm, and the first antenna arm reflects electromagnetic waves of the second antenna arm, thereby improving radiation performance of the antenna.

BRIEF DESCRIPTION OF THE DRAWINGS

To describe the technical solutions in the embodiments of the present invention more clearly, the following briefly describes the accompanying drawings required for describing the embodiments or the prior art. Apparently, the accompanying drawings in the following description show merely some embodiments of the present invention, and a person of ordinary skill in the art may still derive other drawings from these accompanying drawings without creative efforts.

DETAILED DESCRIPTION

The following clearly and completely describes the technical solutions in the embodiments of the present invention with reference to the accompanying drawings in the embodiments of the present invention. Apparently, the described embodiments are merely some but not all of the embodiments of the present invention. All other embodiments obtained by a person of ordinary skill in the art based on the embodiments of the present invention without creative efforts shall fall within the protection scope of the present invention.

In the descriptions of the present invention, it should be understood that direction or position relationships indicated by terms "center", "up", "down", "front", "behind", "left", "right", "vertical", "horizontal", "top", "bottom", "inside", "outside", and the like are based on direction or position relationships shown in the accompanying drawings, and are used only for conveniently describing the present invention and for description simplicity, but do not indicate or imply that an indicated apparatus or element must have a specific direction or must be constructed and operated in a specific direction. Therefore, this cannot be understood as a limitation on the present invention.

Figure 1:
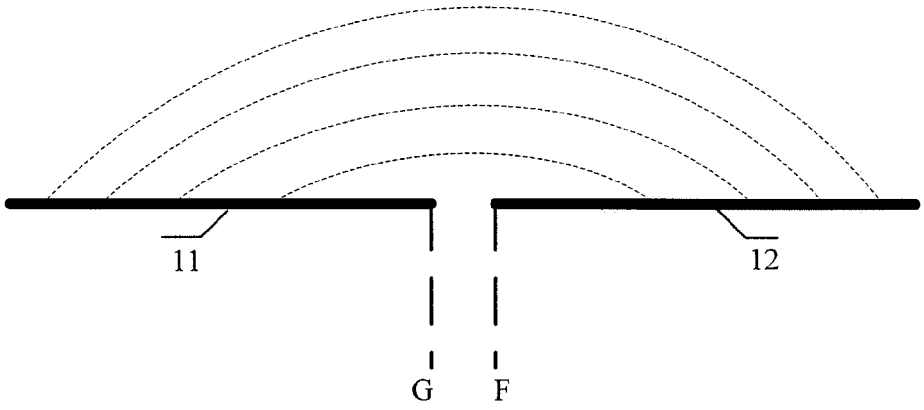
FIG. 1 is a schematic diagram of a dipole antenna and radiation directions of the antenna according to the prior art.
Figure 2:
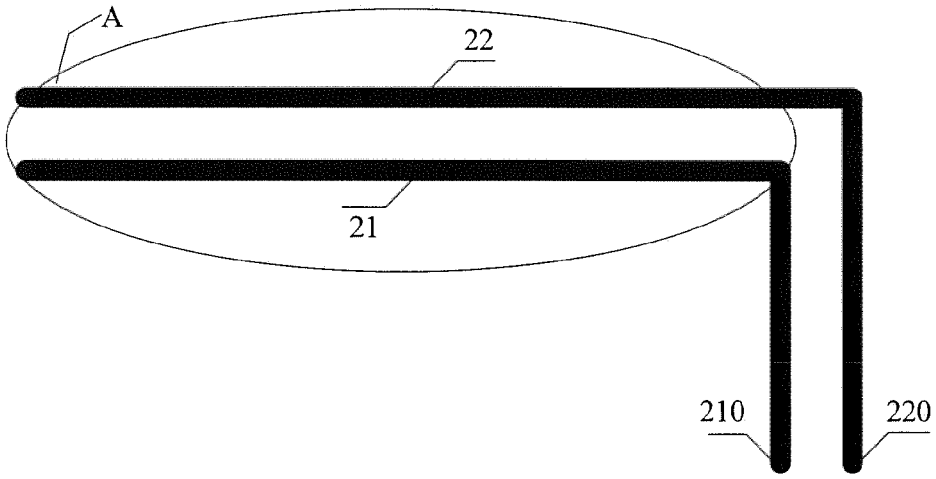
FIG. 2 is a schematic diagram of an antenna according to an embodiment of the present invention.

An embodiment of the present invention provides a specific embodiment of an antenna, as shown in FIG. 2. The antenna in this embodiment of the present invention may also be used as a coupled GPS (Global Positioning System, Global Positioning System) antenna, and the antenna includes a first antenna arm 21 and a second antenna arm 22 that are not in contact with each other, where one end 210 of the first antenna arm 21 is configured for grounding, one end 220 of the second antenna arm 22 is configured to connect to a feed point, and the first antenna arm 21 and the second antenna arm 22 have at least one relative area, as shown by an area A in FIG. 2.

Optionally, shapes of the first antenna arm 21 and the second antenna arm 22 may be flake-shaped, or may be line-shaped.

Figure 3:
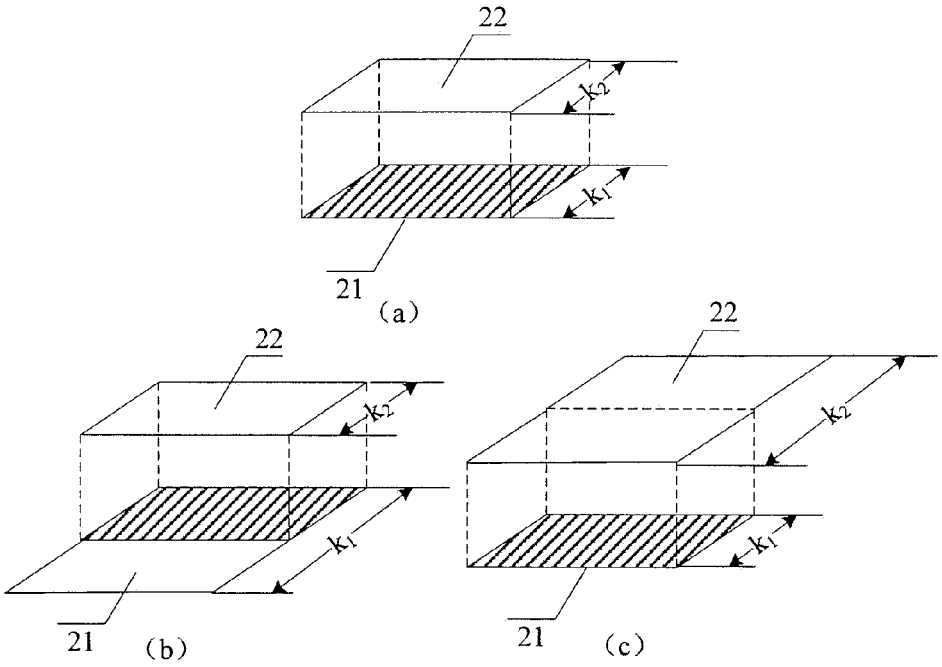
FIG. 3 is a schematic diagram of a relative area of antenna arms, with different widths, of an antenna according to an embodiment of the present invention.

If the shapes of the first antenna arm 21 and the second antenna arm 22 are both flake-shaped, as shown in FIG. 3(*a*), the relative area of the first antenna arm 21 and the second antenna arm 22 may use, as a reference plane, a plane on which the first antenna arm 21 is located, and an overlapped area between an area projected in a vertical direction of the reference plane by the second antenna arm 22 onto the reference plane, and the first antenna arm 21 is used as the relative area of the first antenna arm 21 and the second antenna arm 22, as shown by a slash area in FIG. 3(*a*); or may use, as a reference plane, a plane on which the second antenna arm 22 is located, and an overlapped area between an area projected in a vertical direction of the reference plane by the first antenna arm 21 onto the reference plane, and the second antenna arm 22 is used as the relative area of the first antenna arm 21 and the second antenna arm 22.

If the shapes of the first antenna arm 21 and the second antenna arm 22 are line-shaped, a plane on which vertical lines of the first antenna arm 21 and the second antenna arm 22 are located is fixed. Then, a plane perpendicular to the vertical plane is used as a reference plane, and an overlapped area between an area projected by the first antenna arm 21 onto the reference plane, and an area projected by the second antenna arm 22 onto the reference plane is a relative area of the first antenna arm 21 and the second antenna arm 22.

Optionally, the first antenna arm 21 and the second antenna arm 22 may be linear, or may be arc-shaped within any one of the relative area/areas.

Optionally, an arm distance between the first antenna arm 21 and the second antenna arm 22 is a constant value within any one of the relative area/areas of the first antenna arm 21 and the second antenna arm 22.

Optionally, if the first antenna arm 21 and the second antenna arm 22 are linear within the relative area, that is, the first antenna arm 21 and the second antenna arm 22 are straight, a relative area of the first antenna arm 21 and the second antenna arm 22 is parallel.

Optionally, if the first antenna arm 21 and the second antenna arm 22 are arc-shaped within the relative area, normal distances between the first antenna arm 21 and the second antenna arm 22 are equal everywhere within the relative area, that is, the arm distance between the first antenna arm 21 and the second antenna arm 22 is a constant value.

Optionally, if the first antenna arm 21 and the second antenna arm 22 have at least two relative areas, arm distances between the first antenna arm 21 and the second antenna arm 22 are equal within the at least two relative areas.

Optionally, if the first antenna arm 21 and the first antenna arm 22 are flake-shaped, widths of the first antenna arm 21 and the first antenna arm 22 may be equal, or may be not equal. That is, a width of the first antenna arm 21 is equal to a width of the first antenna arm 22, or a width of the first antenna arm 21 is less than a width of the first antenna arm 22, or a width of the first antenna arm 21 is greater than a width of the first antenna arm 22.

As shown in FIG. 3(*a*), the width of the first antenna arm 21 is k1, a width of the second antenna arm 22 is k2, and k1=k2. Then, a width of the relative area (such as an area represented by slashes in FIG. 3(*a*)) of the first antenna arm 21 and the first antenna arm 22 may be equal to the width of the first antenna arm 21 or the width of the first antenna arm 22.

As shown in FIG. 3(*b*), the width of the first antenna arm 21 is k1, a width of the second antenna arm 22 is k2, and k1>k2. Then, a width of the relative area (such as an area represented by slashes in FIG. 3(*b*)) of the first antenna arm 21 and the first antenna arm 22 may be equal to the width of second antenna arm 22.

As shown in FIG. 3(*c*), the width of the first antenna arm 21 is k1, a width of the second antenna arm 22 is k2, and k1<k2. Then, a width of the relative area (such as an area represented by slashes in FIG. 3(*c*)) of the first antenna arm 21 and the first antenna arm 22 may be equal to the width of first antenna arm 21.

It should be noted that, the antenna shown in FIG. 2 and FIG. 3 is merely a schematic diagram, and any antenna that has the foregoing first antenna arm and the foregoing second antenna arm and is constituted with characteristics of the foregoing first antenna arm and the foregoing second antenna falls within the protection scope of the present invention.

According to the antenna provided in this embodiment of the present invention, the antenna includes a first antenna arm and a second antenna arm that are not in contact with each other, where one end of the first antenna arm is configured for grounding, one end of the second antenna arm is configured to connect to a feed point, and the first antenna arm and the second antenna arm have at least one relative area, so that the first antenna arm performs coupling with the second antenna arm, and the first antenna arm reflects electromagnetic waves of the second antenna arm, thereby improving radiation performance of the antenna.

Figure 4:
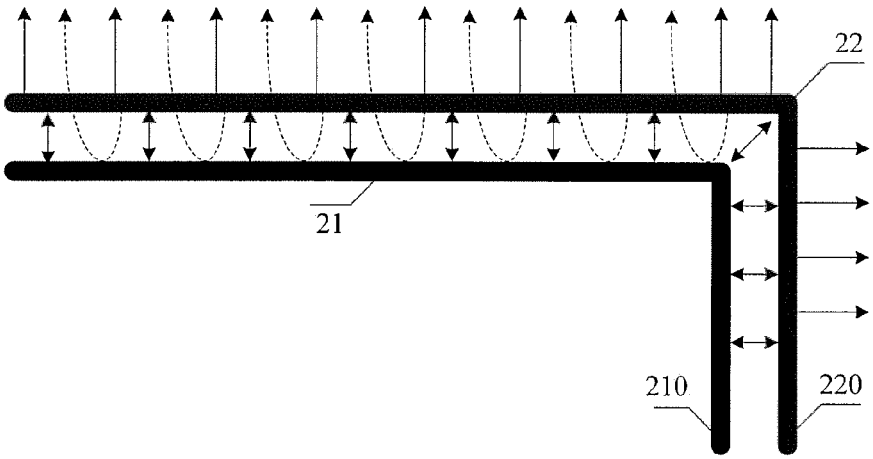
FIG. 4 is a schematic diagram of radiation directions of an antenna according to an embodiment of the present invention.

The antenna shown in FIG. 2 is used as an example, and a diagram of radiation directions of electromagnetic waves of the first antenna arm 21 and the second antenna arm 22 is shown in FIG. 4.

As shown in FIG. 4, a solid line with a single arrow represents that the second antenna arm 22 radiates electromagnetic waves outwards, a solid line with double arrows represents that the first antenna arm 21 performs coupling with the second antenna arm 22, and a dashed-line with a single arrow represents that the first antenna arm 21 reflects the electromagnetic waves radiated by the second antenna arm 22. Therefore, electromagnetic waves over an upper hemisphere of the antenna are enhanced. Further, compared with an original antenna (such as a dipole antenna, a monopole antenna, and a loop antenna), the antenna in the present invention has relatively high upper hemisphere partial radiated power and upper hemisphere isotropic sensitivity, thereby improving performance of the antenna.

Figure 5:
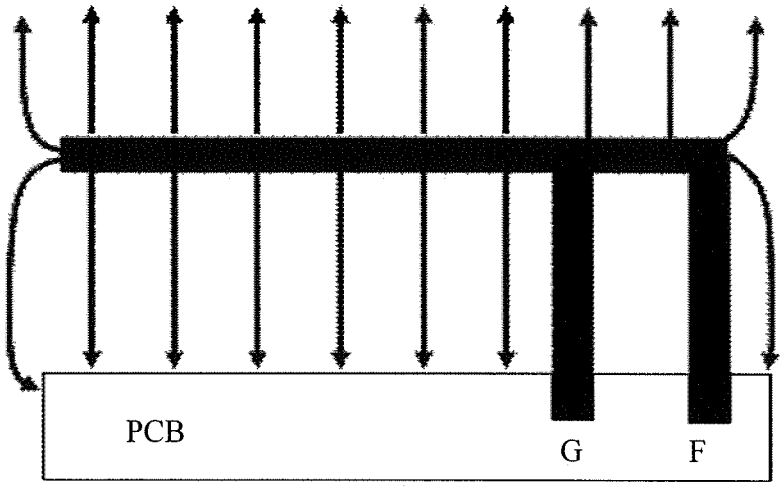
FIG. 5 is a schematic diagram of an inverted F antenna and radiation directions of the antenna according to the prior art.
Figure 6:
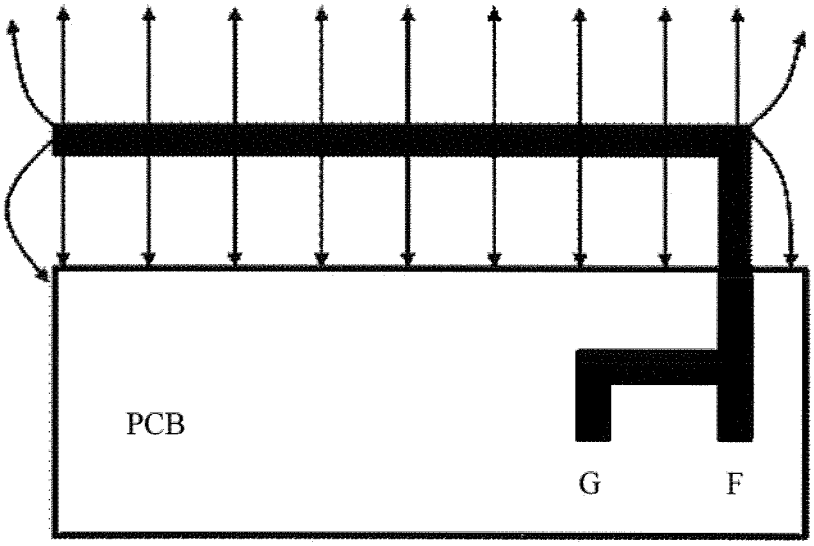
FIG. 6 is a schematic diagram of a PIFA antenna and radiation directions of the antenna according to the prior art.

Exemplarily, FIG. 5 is a diagram of radiation directions of an inverted F antenna (Invert F Antenna, IFA for short) used in the prior art. A solid line with a single arrow in FIG. 5 represents a radiation direction of an electromagnetic wave of the IFA antenna. FIG. 6 is a diagram of radiation directions of a printed inverted F antenna (Printed Invert F Antenna, PIFA antenna for short) used in the prior art. A solid line with a single arrow in FIG. 6 represents a radiation direction of an electromagnetic wave of the PIFA antenna. G in FIG. 5 and FIG. 6 represents a grounding end, and F represents a feed end. It can be learned from FIG. 5 and FIG. 6 that, an antenna branch (that is, the first antenna arm) that is of the existing IFA antenna and PIFA antenna and has a feed end has strong coupling with a printed circuit board (Printed Circuit Board, PCB for short). However, as shown in FIG. 4, in the diagram of radiation directions of the antenna in the present invention, an antenna branch (that is, the second antenna arm 22) connected to the feed point has strong coupling with an antenna branch (that is, the first antenna arm 21) connected to the grounding end, which reduces coupling with the printed circuit board. In addition, the antenna branch (that is, the first antenna arm 21) connected to the grounding end reflects electromagnetic wave radiation of the antenna branch (that is, the second antenna arm 22) connected to the feed point.

Further, an embodiment of the present invention further provides simulation comparison between an existing loop antenna and the antenna in the present invention, so as to prove that the antenna in the present invention can better improve upper hemisphere partial radiated power, thereby improving radiation performance of the antenna.

TABLE 1

| Simulation parameters of a loop antenna | | | |
|---|---|---|---|
| Free | | | |
| Freq(MHz) | Eff(dB) | Eff(%) | UHPRP/TRP ratio (%) |
| 1500 | −2.86008 | 51.7597 | 42.7727 |
| 1505 | −2.62594 | 54.6269 | 42.7676 |
| 1510 | −2.40958 | 57.4172 | 42.8242 |
| 1515 | −2.19566 | 60.3162 | 42.9288 |
| 1520 | −2.03498 | 62.5896 | 43.0356 |
| 1525 | −1.88301 | 64.8186 | 43.1706 |
| 1530 | −1.75618 | 66.7393 | 43.3274 |
| 1535 | −1.69308 | 67.7161 | 43.4113 |
| 1540 | −1.57098 | 69.6469 | 43.4814 |
| 1545 | −1.46245 | 71.4093 | 43.5675 |
| 1550 | −1.42101 | 72.0939 | 43.6233 |
| 1555 | −1.39869 | 72.4655 | 43.7012 |
| 1560 | −1.33021 | 73.6171 | 43.7425 |
| 1565 | −1.3234 | 73.7326 | 43.8147 |
| 1570 | −1.36892 | 72.9639 | 43.8926 |
| 1575 | −1.39078 | 72.5976 | 44.0358 |
| 1580 | −1.4028 | 72.3969 | 44.1195 |
| 1585 | −1.48075 | 71.109 | 44.2142 |
| 1590 | −1.57231 | 69.6257 | 44.3664 |
| 1595 | −1.64492 | 68.4712 | 44.5132 |
| 1600 | −1.7139 | 67.3923 | 44.6296 |
| (a) | | | |
| BHHR | | | |
| Freq(MHz) | Eff(dB) | Eff(%) | UHPRP/TRP ratio (%) |
| 1500 | −9.56245 | 11.06 | 40.2507 |
| 1505 | −9.42791 | 11.408 | 40.0772 |
| 1510 | −9.31872 | 11.6984 | 39.9176 |
| 1515 | −9.20087 | 12.0202 | 39.7891 |
| 1520 | −9.11783 | 12.2523 | 39.6788 |
| 1525 | −9.08808 | 12.3365 | 39.5382 |
| 1530 | −9.06554 | 12.4007 | 39.4648 |
| 1535 | −9.0894 | 12.3328 | 39.358 |
| 1540 | −8.982 | 12.6415 | 39.3015 |
| 1545 | −8.89572 | 12.8952 | 39.1812 |
| 1550 | −8.90427 | 12.8698 | 39.1122 |
| 1555 | −8.86012 | 13.0014 | 39.0817 |
| 1560 | −8.83899 | 13.0647 | 39.086 |
| 1565 | −8.89899 | 12.8855 | 39.0373 |
| 1570 | −8.95639 | 12.7163 | 39.0568 |
| 1575 | −8.97917 | 12.6498 | 39.1523 |
| 1580 | −9.04368 | 12.4633 | 39.2263 |
| 1585 | −9.13379 | 12.2073 | 39.3005 |
| 1590 | −9.17258 | 12.0988 | 39.4504 |
| 1595 | −9.26576 | 11.842 | 39.6654 |
| 1600 | −9.29672 | 11.7579 | 39.8209 |
| (b) | | | |

"Free" in Table 1(a) represents antenna parameters when a loop antenna is in a free space (Free Space, FS for short) test state, and "BHHR" in Table 1(b) represents antenna parameters when a loop antenna is in a Beside Head and Hand Right Side (Beside Head and Hand Right Side in Head and Hand Phantom, BHHR for short) test state. In Table 1(a) and Table 1(b), "Freq (MHz)" represents frequency with a unit of megahertz, "Eff (dB)" represents efficiency with a unit of decibel, "Eff (%)" represents efficiency, and "UHPRP/TRP Ratio (%)" represents a percentage of upper hemisphere partial radiated power (Upper Hemisphere Partial Radiation Power, UHPRP for short) of the loop antenna to total radiated power (Total Radiation Power, TRP for short).

TABLE 2

| Simulation parameters of the antenna in the present invention | | | |
|---|---|---|---|
| Free | | | |
| Freq(MHz) | Eff(dB) | Eff(%) | UHPRP/TRP ratio (%) |
| 1500 | −10.5138 | 8.88425 | 39.3375 |
| 1505 | −9.81581 | 10.4332 | 39.4632 |
| 1510 | −9.14046 | 12.1886 | 39.6174 |
| 1515 | −8.42082 | 14.3853 | 39.7487 |

TABLE 2-continued

| Simulation parameters of the antenna in the present invention | | | |
|---|---|---|---|
| 1520 | −7.77591 | 16.6882 | 39.9868 |
| 1525 | −7.14638 | 19.2913 | 40.2493 |
| 1530 | −6.49818 | 22.3966 | 40.5295 |
| 1535 | −5.88244 | 25.8081 | 40.9168 |
| 1540 | −5.21956 | 30.0638 | 41.2221 |
| 1545 | −4.62105 | 34.506 | 41.6807 |
| 1550 | −4.11722 | 38.7506 | 42.2947 |
| 1555 | −3.67414 | 42.9128 | 42.9524 |
| 1560 | −3.23306 | 47.5 | 43.7755 |
| 1565 | −2.84289 | 51.965 | 44.3682 |
| 1570 | −2.4878 | 56.3923 | 44.5587 |
| 1575 | −2.15298 | 60.9118 | 44.5651 |
| 1580 | −1.89609 | 64.6235 | 44.4212 |
| 1585 | −1.7761 | 66.434 | 44.2913 |
| 1590 | −1.73711 | 67.033 | 44.2743 |
| 1595 | −1.76669 | 66.578 | 44.2722 |
| 1600 | −1.85265 | 65.2733 | 44.2401 |
| | | (a) | |

| BHHR | | | |
|---|---|---|---|
| Freq(MHz) | Eff(dB) | Eff(%) | UHPRP/TRP ratio (%) |
| 1500 | −14.0246 | 3.95859 | 39.3382 |
| 1505 | −13.4151 | 4.55502 | 38.8335 |
| 1510 | −12.8517 | 5.18591 | 38.5264 |
| 1515 | −12.2761 | 5.92092 | 38.3847 |
| 1520 | −11.7853 | 6.62935 | 38.3933 |
| 1525 | −11.2971 | 7.41814 | 38.4791 |
| 1530 | −10.8333 | 8.2542 | 38.5894 |
| 1535 | −10.437 | 9.04279 | 39.01 |
| 1540 | −9.99198 | 10.0185 | 39.326 |
| 1545 | −9.58918 | 10.9921 | 39.71 |
| 1550 | −9.2726 | 11.8234 | 40.2688 |
| 1555 | −8.98226 | 12.6408 | 40.6667 |
| 1560 | −8.70971 | 13.4595 | 41.1332 |
| 1565 | −8.57982 | 13.8681 | 441.4865 |
| 1570 | −8.50201 | 14.1188 | 41.8101 |
| 1575 | −8.45346 | 14.2776 | 42.0825 |
| 1580 | −8.4778 | 14.1978 | 42.269 |
| 1585 | −8.55627 | 13.9435 | 42.2747 |
| 1590 | −8.68101 | 13.5487 | 42.2963 |
| 1595 | −8.81833 | 13.127 | 42.2099 |
| 1600 | −8.95784 | 12.7121 | 42.1601 |
| | | (b) | |

Table 2 is simulation parameters of the antenna in the present invention shown in FIG. 2. "Free" in Table 2(a) represents antenna parameters when the antenna in the present invention is in a free space test state, and "BHHR" in Table 2(b) represents antenna parameters when the antenna in the present invention is in a BHHR test state. In Table 2(a) and Table 2(b), "Freq (MHz)" represents frequency with a unit of megahertz, "Eff (dB)" represents efficiency with a unit of decibel, "Eff (%)" represents efficiency, and "UHPRP/TRP Ratio (%)" represents a percentage of upper hemisphere partial radiated power of the antenna in the present invention to total radiated power.

Free space in Table 1(a) and Table 2(b) refers to propagation space without any attenuation, blocking, or multipath. The Beside Head and Hand Right Side test state in Table 1(b) and Table 2(b) is a space state in which attenuation, blocking, multipath propagation, and the like exist during actual use of an antenna. In addition, "Eff (dB)" and "Eff (%)" in Table 1 and Table 2 represent a same meaning, and are merely represented by using two different units, where the two parameters may be converted to each other.

It can be learned by comparing Table 1(a) with Table 2(a) that, when the loop antenna and the antenna in the present invention are both in the Free test state, because the antenna in the present invention can change the diagram of the radiation directions of the antenna, efficiency of the antenna in the present invention is lower than that of the loop antenna, but a percentage of upper hemisphere partial radiated power to total radiated power is comparable between the antenna in the present invention and the loop antenna.

It can be learned by comparing Table 1(b) with Table 2(b) that, when the loop antenna and the antenna in the present invention are both in the BHHR test state, in a range of frequencies higher than 1565 MHz (including 1565 MHz), both the efficiency and the percentage of upper hemisphere partial radiated power to total radiated power of the antenna in the present invention are higher than those of the loop antenna. In an actual use process, an antenna is always in the BHHR state, and therefore the antenna in the present invention has higher upper hemisphere partial radiated power than the original loop antenna. Further, with the diagram of the radiation directions of the antenna in the present invention, the upper hemisphere partial radiated power and the upper hemisphere isotropic sensitivity of the antenna are improved, thereby improving radiation performance of the antenna.

Further, for the characteristics of the first antenna arm 21 and the second antenna arm 22, capacity between the first antenna arm 21 and the second antenna arm 22 and energy stored between the first antenna arm 21 and the second antenna arm 22 are calculated.

Specifically, if a shape between the first antenna arm 21 and the second antenna arm 22 and dielectric performance of an insulator between the first antenna arm 21 and the second antenna arm 22 are known, capacitance can be calculated.

Exemplarily, the antenna shown in FIG. 2 is used as an example. It is assumed that the first antenna arm 21 and the first antenna arm 22 are flake-shaped; then, capacitance between the first antenna arm 21 and the first antenna arm 22 can be calculated by using a first formula, where the first formula is:

$$C = \varepsilon_r \varepsilon_0 \frac{A}{d},$$

where C represents the capacitance between the first antenna arm 21 and the second antenna arm 22, A represents the relative area of the first antenna arm 21 and the second antenna arm 22, d represents the arm distance between the first antenna arm 21 and the second antenna arm 22, $\varepsilon_r$ represents a dielectric constant of a dielectric between the first antenna arm 21 and the second antenna arm 22, and in a case of a vacuum, $\varepsilon_r=1$, and $\varepsilon_0$ represents an electrical constant, and generally, $\varepsilon_0 \approx 8.854 \times 10^{-12}$ F/m (farad/meter).

It can be learned from the foregoing first formula that, the capacitance C between the first antenna arm 21 and the second antenna arm 22 is directly proportional to the relative area A of the first antenna arm 21 and the second antenna arm 22, and is inversely proportional to the arm distance d between the first antenna arm 21 and the second antenna arm 22. Therefore, in actual design of an antenna, in order to make the capacitance C between the first antenna arm 21 and the second antenna arm 22 larger, the relative area A of the first antenna arm 21 and the second antenna arm 22 should be as large as possible, and/or the arm distance between the first antenna arm 21 and the second antenna arm 22 should be as small as possible. Certainly, during design and a layout of an antenna, a scenario to which the antenna is applied should also be considered so as to properly design the antenna in a case in which a requirement is met.

Further, when the arm distance d between the first antenna arm 21 and the second antenna arm 22 is extremely small relative to another parameter (such as the relative area A) of the first antenna arm 21 and the second antenna arm 22, an electric field through the relative area A of the first antenna arm 21 and the second antenna arm 22 is basically consistent. When the distance d between the first antenna arm 21 and the second antenna arm 22 becomes larger, edge fields generated in edge areas of the first antenna arm 21 and the second antenna arm 22 can also have a particular effect of reflection.

Further, according to the International System of Units, that is, the centimeter-gram-second system (Centimeter-Gram-Second, CGS for short), another description form of the first formula can be derived from the foregoing first formula:

$$C = \varepsilon_r \frac{A}{4\pi d},$$

where C represents the capacitance of the first antenna arm 21 and the second antenna arm 22, A represents the relative area of the first antenna arm 21 and the second antenna arm 22, d represents the arm distance between the first antenna arm 21 and the second antenna arm 22, and $\varepsilon_r$ represents the dielectric constant of the dielectric between the first antenna arm 21 and the second antenna arm 22, and in a case of a vacuum, $\varepsilon_r=1$.

Further, with reference to the International System of Units (System International, SI for short) equation, the foregoing energy stored between the first antenna arm 21 and the second antenna arm 22 can be calculated by using a second formula, where the second formula is:

$$W_{stored} = \frac{1}{2}CV^2 = \frac{1}{2}\varepsilon_r\varepsilon_0\frac{A}{d}V^2,$$

where $W_{stored}$ represents the energy stored, between the first antenna arm 21 and the second antenna arm 22, with a unit of joule (J), C represents the capacitance of the first antenna arm 21 and the second antenna arm 22 with a unit of farad (F), V represents a voltage between the first antenna arm 21 and the second antenna arm 22 with a unit of volt (V), A represents the relative area of the first antenna arm 21 and the second antenna arm 22, d represents the arm distance between the first antenna arm 21 and the second antenna arm 22, $\varepsilon_r$ represents the dielectric constant of the dielectric between the first antenna arm 21 and the second antenna arm 22, and in a case of a vacuum, $\varepsilon_r=1$, $\varepsilon_0$ represents the electrical constant, and generally, $\varepsilon_0 \approx 8.854\times10^{-12}$ F/m.

It can be learned from the first formula and the second formula that, a smaller arm distance between the first antenna arm 21 and the second antenna arm 22 and a larger relative area of the first antenna arm 21 and the second antenna arm 22 indicate stronger capacitance (that is, an electromagnetic field) between the first antenna arm 21 and the second antenna arm 22. In addition, because the second antenna arm 22 reflects electromagnetic waves of the first antenna arm 21, the electromagnetic field of the antenna is more centralized, thereby improving radiation performance of the antenna.

An embodiment of the present invention further provides a mobile terminal, including a housing and the antenna in any one of the foregoing embodiments, where a first antenna arm of the antenna is located on an inner side of a second antenna arm of the antenna. The inner side is based on a center point of the mobile terminal, where a side close to the center point is the inner side, and a side far away from the center point is an outer side. Because the mobile terminal provided in this embodiment of the present invention is provided with the antenna in any one of the foregoing embodiments, same technical effects can be also produced, so as to resolve a same technical problem. The foregoing mobile terminal is a communications device used during a moving situation, and may be a mobile phone, or may be a tablet, which is certainly not limited thereto.

Optionally, the antenna may be outside the mobile terminal, or may be inside the mobile terminal and located in a corner of the mobile terminal. Preferably, the antenna is inside the mobile terminal, and is generally located in the upper left or the upper right of the mobile terminal.

Optionally, the antenna is disposed on a periphery of an internal device of the mobile terminal device. Generally, because a volume of the mobile terminal is extremely small, and another electronic device is included inside the mobile terminal, a proper antenna is designed according to the periphery of the internal device of the mobile terminal device in a case in which a requirement is met.

According to the mobile terminal provided in this embodiment of the present invention, an antenna in this mobile terminal includes a first antenna arm and a second antenna arm that are not in contact with each other, where one end of the first antenna arm is configured for grounding, one end of the second antenna arm is configured to connect to a feed point, and the first antenna arm and the second antenna arm have at least one relative area, so that the first antenna arm performs coupling with the second antenna arm, and the first antenna arm reflects electromagnetic waves of the second antenna arm, thereby improving radiation performance of the antenna.

Figure 7:
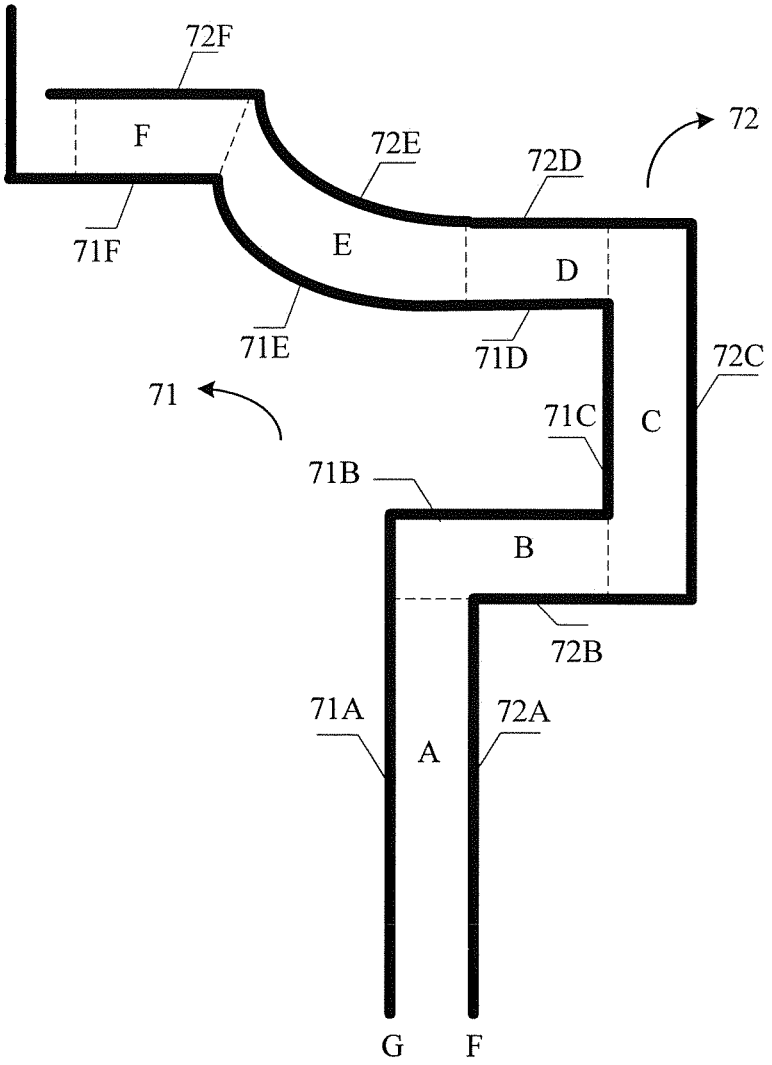
FIG. 7 is a schematic diagram of an antenna applied to a mobile phone according to an embodiment of the present invention.

An embodiment of the present invention provides an antenna applied to a mobile phone, as shown in FIG. 7. In FIG. 7, "G" represents a grounding end, and "F" represents a feed end.

Specifically, the antenna shown in FIG. 7 is divided into six areas: A, B, C, D, E, and F, and each of the six areas is a relative area of a first antenna arm and a second antenna arm. In the area A in FIG. 7, a first antenna arm is 71A, and a second antenna arm is 72A; in the area B, a first antenna arm is 71B, and a second antenna arm is 72B; in the area C, a first antenna arm is 71C, and a second antenna arm is 72C; in the area D, a first antenna arm is 71D, and a second antenna arm is 72D; in the area E, a first antenna arm is 71E, and a second antenna arm is 72E; and in the area F, a first antenna arm is 71F, and a second antenna arm is 72F. The first antenna arms (71A, 71B, 71C, 71D, 71E, and 71F) in all the areas A, B, C, D, E, and F are a first antenna arm 71 of the antenna, and the second antenna arms (72A, 72B, 72C, 72D, 72E, and 72F) in all the areas A, B, C, D, E, and F are a second antenna arm 72 of the antenna.

It can be learned from FIG. 7 that, in the area A, the first antenna arm 71A is parallel to the second antenna arm 72A; in the area B, the first antenna arm 71B is parallel to the second antenna arm 72B; in the area C, the first antenna arm 71C is parallel to the second antenna arm 72C; in the area D, the first antenna arm 71D is parallel to the second antenna arm 72D; in the area F, the first antenna arm 71F is parallel to the second antenna arm 72F; and in the area E, the first antenna arm 71E and the second antenna arm 72E are arc-shaped, and normal distances are equal.

It should be noted that, the antenna, shown in FIG. 7, in the mobile phone is merely a schematic diagram, area division of the antenna, shown in FIG. 7, in the mobile phone is merely for description simplicity, and another antenna constituted by a first antenna arm and a second antenna arm with the foregoing technical features shall fall within the protection scope of the present invention.

Finally, it should be noted that the foregoing embodiments are merely intended for describing the technical solutions of the present invention but not for limiting the present invention. Although the present invention is described in detail with reference to the foregoing embodiments, persons of ordinary skill in the art should understand that they may still make modifications to the technical solutions described in the foregoing embodiments or make equivalent replacements to some technical features thereof, without departing from the spirit and scope of the technical solutions of the embodiments of the present invention.

What is claimed is:

1. An antenna, comprising:

a first antenna arm;

a second antenna arm;

wherein the first antenna arm and the second antenna arm are not in contact with each other; and wherein one end of the first antenna arm is configured for grounding, one end of the second antenna arm is configured to connect to a feed point, the first antenna arm and the second antenna arm have at least two relative areas, and arm distances between the first antenna arm and the second antenna arm are equal within the at least two relative areas.

2. The antenna according to claim 1, wherein an arm distance between the first antenna arm and the second antenna arm is a constant value within any one of the at least two relative areas.

3. An antenna, comprising:

a first antenna arm;

a second antenna arm;

wherein the first antenna arm and the second antenna arm are not in contact with each other;

wherein one end of the first antenna arm is configured for grounding, one end of the second antenna arm is configured to connect to a feed point, and the first antenna arm and the second antenna arm have at least one relative area; and wherein the first antenna arm and the second antenna arm are flake-shaped, and a width of the first antenna arm is equal to a width of the second antenna arm.

4. The antenna according to claim 1, wherein the first antenna arm and the second antenna arm are linear or arc-shaped within each relative area.

5. A mobile terminal, comprising:

a housing;

an antenna comprising:

a first antenna arm and a second antenna arm that are not in contact with each other;

wherein one end of the first antenna arm is configured for grounding, one end of the second antenna arm is configured to connect to a feed point, and the first antenna arm and the second antenna arm have at least two relative areas;

wherein the first antenna arm of the antenna is located on an inner side of the second antenna arm of the antenna; and arm distances between the first antenna arm and the second antenna arm are equal within the at least two relative areas.

6. A mobile terminal, comprising:

a housing;

an antenna comprising:

a first antenna arm and a second antenna arm that are not in contact with each other;

wherein one end of the first antenna arm is configured for grounding, one end of the second antenna arm is configured to connect to a feed point, and the first antenna arm and the second antenna arm have at least one relative area;

wherein the first antenna arm of the antenna is located on an inner side of the second antenna arm of the antenna; and wherein the first antenna arm and the second antenna arm are flake-shaped, and a width of the first antenna arm is equal to a width of the second antenna arm.

7. The mobile terminal according to claim 5, wherein the first antenna arm and the second antenna arm are linear or arc-shaped within each relative area.

8. The mobile terminal according to claim 5, wherein the antenna is located inside the housing of the mobile terminal, and is located in a corner of the mobile terminal.

9. The mobile terminal according to claim 5, wherein the antenna is disposed on a periphery of an internal device of the mobile terminal.

* * * * *